US005341780A

United States Patent [19]

Rau et al.

[11] Patent Number: 5,341,780

[45] Date of Patent: Aug. 30, 1994

[54] DEVICE TO SUPPRESS FIRING IMPULSE TORQUE INDUCED VIBRATIONS IN INTERNAL COMBUSTION ENGINES

[76] Inventors: Charles B. Rau, 2900 Bristol St., G106, Costa Mesa, Calif. 92626; Douglas D. Fisher, 5320 Bindewald Rd., Torrance, Calif. 90505

[21] Appl. No.: 99,744

[22] Filed: Jul. 30, 1993

[51] Int. Cl.[5] ..... F02B 75/06

[52] U.S. Cl. ..... 123/192.1; 74/574

[58] Field of Search ..... 123/192.1; 74/574

[56] References Cited

U.S. PATENT DOCUMENTS

| | | | |
|---|---|---|---|
| Re. 15,645 | 5/1915 | Tibbetts | 74/574 |
| 1,377,849 | 5/1921 | Ofeldt | 74/574 |
| 1,765,477 | 6/1930 | Ackerman | 74/574 |
| 1,892,793 | 1/1933 | Warner | 74/574 |
| 1,895,825 | 1/1933 | Thomas | 74/574 |
| 1,896,969 | 2/1933 | Paton | 74/574 |
| 1,916,309 | 7/1933 | Griswold | 74/574 |
| 1,917,650 | 7/1933 | Kishline | 74/574 |
| 2,152,710 | 4/1939 | Schwaiger | 74/574 |
| 2,694,947 | 11/1954 | Sarazin | 74/574 |

*Primary Examiner*—Noah P. Kamen

*Attorney, Agent, or Firm*—Denton L. Anderson

[57] ABSTRACT

A device is set forth to suppress vibrations relating to intermittent or uneven piston firing impulse torque in an internal combustion engine. The device is particularly adapted as an after market device for motorcycle engines and includes first and second plates secured to the engine crankshaft and to the engine's drive sprocket. Inertial rings are biased to, in cooperation with friction discs, frictionally couple the plates and rings for mutual rotation below pre-selected shaft torques. Firing impulses resulting in torques exceeding the predetermined value will cause the plates to rotate, restrained by friction, relative to inertial rings to suppress torque related vibration.

6 Claims, 2 Drawing Sheets

DEVICE TO SUPPRESS FIRING IMPULSE TORQUE INDUCED VIBRATIONS IN INTERNAL COMBUSTION ENGINES

FIELD OF THE INVENTION

The present invention relates to a device for suppressing or dampening vibrations in internal combustion engines. More particularly, it relates to devices to suppress vibrations induced by torque on the crankshaft related to intermittent or uneven piston firing impulses.

BACKGROUND OF THE INVENTION

Internal combustion engines are provided with a crankshaft, the output of which powers the vehicle drive train. As internal combustion takes place, the pistons are, during the power stroke, imposing pulses of torque upon the crankshaft. In some engines the piston firing torque impulses may be uneven or intermittent resulting in vibration in crankshaft, drive train and in the vehicle containing the internal combustion engine.

Certain internal combustion engines such as twin cylinder motorcycle engines and the like, may be particularly susceptible to piston firing torque impulse related vibrations. For example, and with particular pertinence to the present invention, most twin cylinder engines, especially the engines known as "V-twin" engines, manufactured by Harley-Davidson Motorcycle Company, Inc. have an intermittent or uneven cylinder filing sequence causing vibration relating to the torque impulses. In the foregoing engine during the 360 degree rotation of the crankshaft, the power strokes of the piston during cylinder firing occur approximately 80 degrees apart with the exhaust, intake and compression strokes encompassing the remaining 280 degrees. Accordingly, it can be seen that the crankshaft observes intermittent piston firing torque impulses during a 360 degree rotation.

By way of further background, the V-twin engines described above include a drive sprocket meshing with a chain which is driven by the drive sprocket, the chain meshing with a transmission input sprocket providing input to the motorcycle transmission. The crankshaft passes through the drive sprocket and is coupled to a device referred to as a compensator. The compensator is thereafter mated to the drive sprocket. The compensator is adapted during engine acceleration to prevent the heavy drive chain from slapping within the housing. The device is not sufficiently adapted to suppress vibrations relating to firing impulse torques.

In regards to automobile engines, it has been known in the prior art to provide a vibration dampening device at the end of the crankshaft opposite the drive train to dampen torsional vibrations. These dampeners are not well suited for installation such as in the V-twin engines referred to above particularly in a manner to cooperate with existing components thereof.

SUMMARY OF THE INVENTION

The present invention relates to a device to suppress firing impulse torque related vibrations at the drive end of the crankshaft. More particularly, it relates to a device to suppress firing impulse torque related vibrations for engines having intermittent or uneven piston power strokes. Still more particularly, it relates to an after market device adapted for installation in V-twin motorcycle engines manufactured by Harley-Davidson Motorcycle Company, Inc. to suppress firing impulse torque related vibrations.

Accordingly, an after market device is provided for installation in motorcycle engines manufactured by Harley-Davidson Motorcycle Company of a type similar to the V-twin, twin cylinder motorcycle engine. The engine as manufactured includes a crankshaft, the drive end of which is adapted to power the drive train for the motorcycle. The drive end of the crankshaft passes through a drive sprocket, the end of the crankshaft having attached thereon by a splined connection to a device referred to as compensator. The compensator in turn is coupled to and drives the drive sprocket, the sprocket in turn driving a chain in turn meshing with a transmission input sprocket providing drive input to the motorcycle transmission. To couple the drive sprocket to the compensator, the sprocket and compensator include cooperatively engaged and axially extending triangular teeth. A bolt axially threaded into the crankshaft affixes the compensator on the crankshaft.

The device, according to the present invention, is adapted to be used in the place of the compensator and to provide suppression of piston firing impulse torque related vibrations. Toward this end, the device includes a first plate secured to the drive sprocket for coaxially rotation therewith. Accordingly, the first plate includes axial recesses adapted to receive the tabs of the drive sprocket. A second plate is secured to the first plate for coaxial rotation therewith, at least one of the first or second plates being attached to the crankshaft as by a splined connection. The first and second plates thereby rotate with the crankshaft and, by virtue of the engagement of the first plate to the drive sprocket, drive the sprocket and the connected chain to provide power to the motorcycle transmission.

Disposed coaxially between the first and second plates are a pair of inertial rings. Annular friction disks are in turn disposed between the inertial rings and the plates. Means are provided for urging the inertial rings to axially press the rings, disks and plates to frictionally slip couple the rings and plates to rotate coaxially below a pre-selected value of firing impulse induced torques. When the pre-selected value of firing impulse torque is exceeded, the plates frictionally slip in relation to the inertial rings resisted by the frictional coupling. Intermittent firing impulse torque related vibrations are thereby suppressed and dissipated as friction in the device.

The urging means of the device according to the present invention are embodied as coil springs disposed between the inertial rings. To prevent the inertial rings from coaxially rotating relative to one another, cooperatively arranged pins and receiving bores are provided restraining the inertial rings from relatively coaxial rotation while at the same time permitting axial displacement occasioned by the urging means described above.

In regards to the specific 90 cubic inch internal combustion engine referred to above, it has been found that suppression of the firing impulse torque related vibration is best achieved when the plates and rings are frictionally coupled for mutual coaxial rotation at torques below 240 inch pounds. Above 240 inch pounds the plates frictionally slip relative to the rings to suppress the aforesaid vibrations.

It has been found that the device according to the present invention acts to suppress vibrations relating to firing sequence impulse torques. It is to be understood that, while the device is particularly adapted as an aftermarket device for Harley-Davidson Motorcycle engines, that it could be adapted as an after market device for other internal combustion engines susceptible to intermittent or uneven piston firings such as in certain marine applications or the like.

BRIEF DESCRIPTION OF THE DRAWINGS

These and other features and advantages of the present invention will become better understood with reference to the specification, claims and drawings wherein:

SPECIFICATION

As hereinafter described, the present invention is particularly adapted as an aftermarket device for use particularly in engines incorporated into motorcycles manufactured by Harley-Davidson Motorcycle Company. With reference to the following specification, it is specifically adapted as a device for V-twin, twin cylinder motorcycle engines to suppress piston firing impulse torque related vibrations.

With specific reference to the aforesaid twin cylinder motorcycle engine and by way of background, the engine includes a crankshaft driven by twin pistons. The pistons' power strokes are approximately 80 degrees apart with the exhaust, intake and compression stroke occupying the remaining some 280 degrees of the engine cycle. Accordingly, the crankshaft observes pistons firing impulse torque in an intermittent or uneven manner through its 360 degrees of rotation as driven by the engine. It has been found that these piston firing impulse torques result in vibrations in the crankshaft which are in turn transmitted to motorcycle drive train and to the overall motorcycle.

Figure 1:
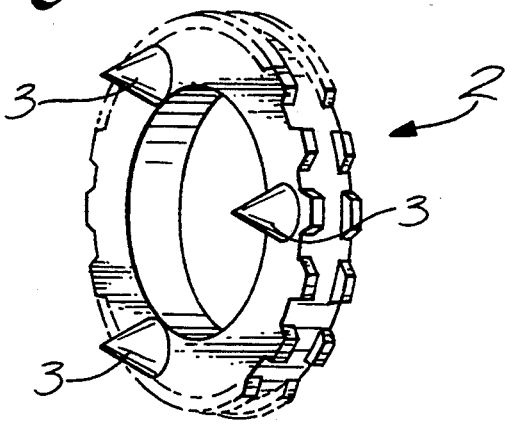
FIG. 1 is a perspective drawing of a manufacturer-provided drive sprocket to which the device according to the present invention is adapted to cooperate to suppress firing impulse torque related vibrations.
Figure 2:
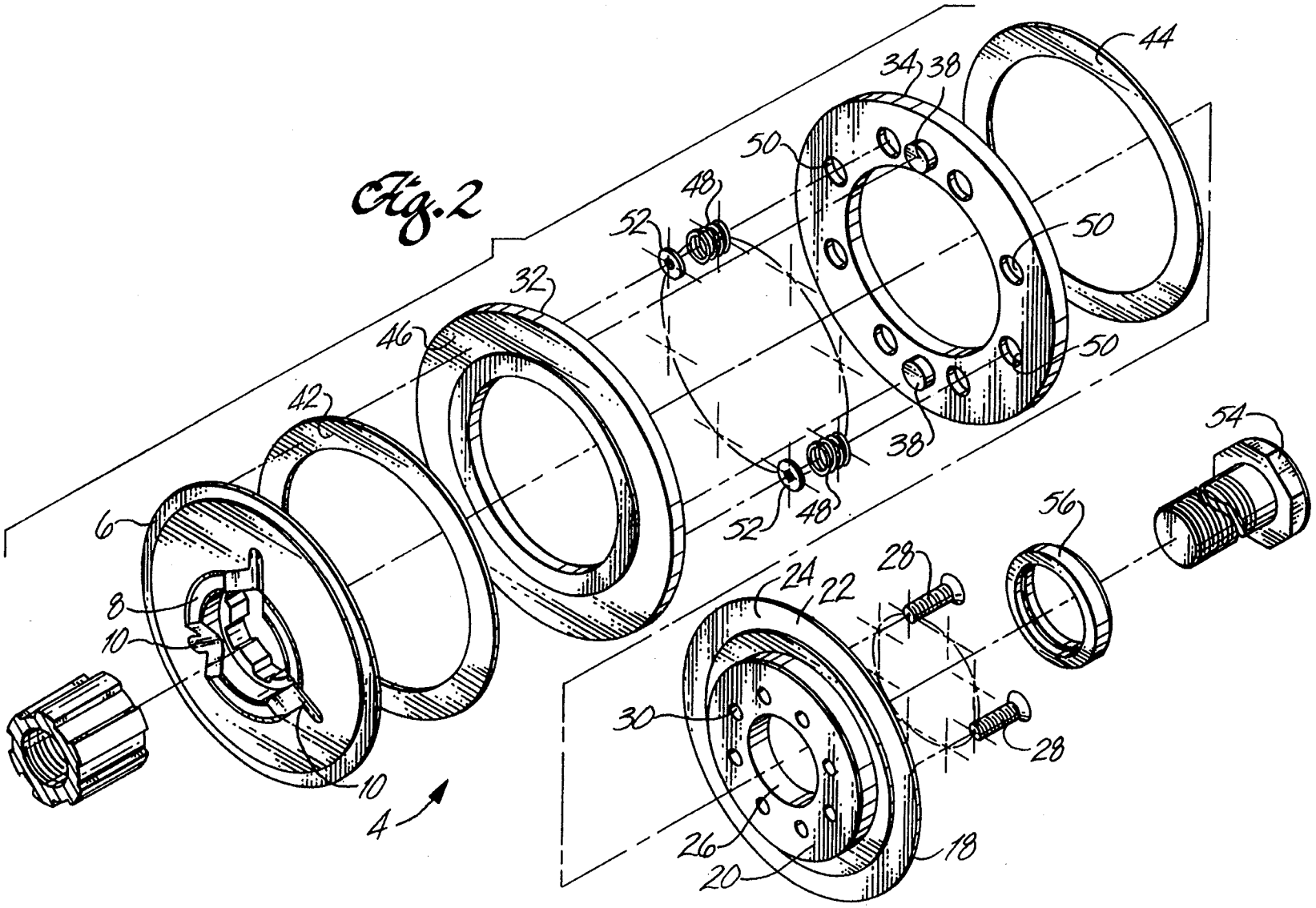
FIG. 2 shows an isometric, exploded view of a device having features of the present invention.

With reference to the drawings, the original manufacture or stock twin motorcycle engine identified above includes, with reference to FIG. 2, a crankshaft 1, the end of which is splined to mount a stock device known as a compensator (not shown). The compensator is bolted to crankshaft 1 and is adapted to mate with a stock drive sprocket 2 shown in FIG. 1. Drive sprocket 2 drives a chain (not shown) which, in a well-known fashion, drives another sprocket providing input to the motorcycle transmission. Drive sprocket 2 freely rotates about crankshaft 1.

To mate the stock compensator and drive sprocket 2, each includes three axially projected teeth 3 disposed at equal intervals about their circumference. The teeth 3 engage to provide a coupling between the compensator and drive sprocket 1. The compensator is suitably broached to mate with the splined crankshaft 1. Accordingly, crankshaft 1, through the compensator and its mating engagement, drives sprocket 2 which in turn drives the motorcycle transmission and the motorcycle itself. The compensator is adapted to prevent the drive chain from slapping adjacent structures during rapid acceleration of the motorcycle.

Figure 3:
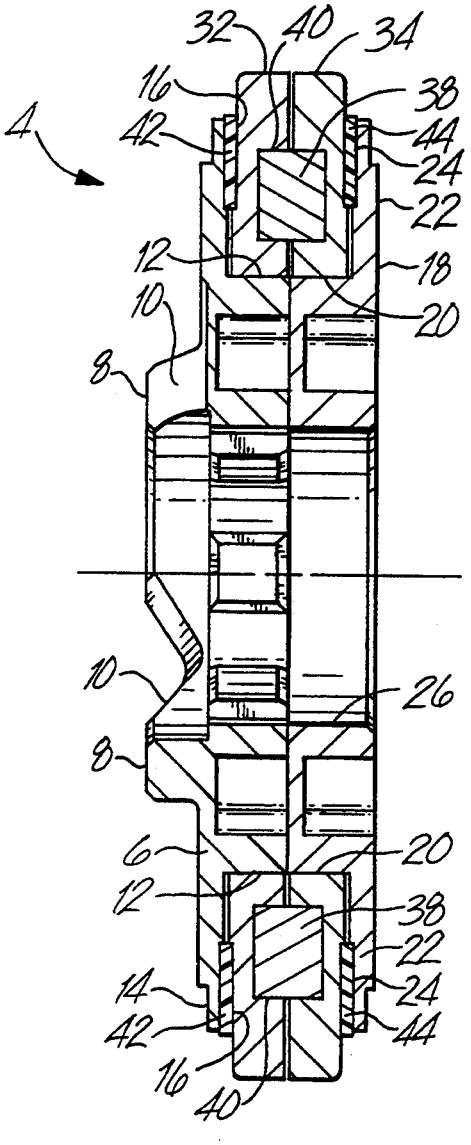
FIG. 3 is a section view of the device of FIG. 2.
Figure 4:
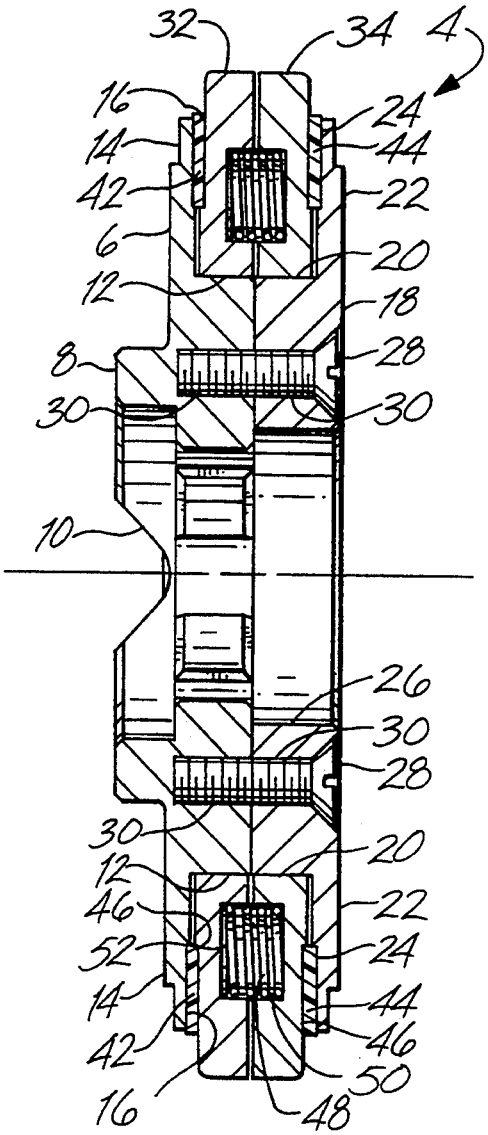
FIG. 4 is a section view through the device of FIG. 2 as rotated 22 ½ degrees clockwise with respect to the cross-section of FIG. 3.

To suppress firing impulse torque-related vibrations, a device 4 according to the present invention is provided as shown in FIGS. 2 through 4. The device 4 is adapted to replace the compensator. Toward this end device 4 includes a first plate 6 having an axially throughbore, a portion of which is broached to secure it to splined crankshaft 1 for mutual rotation. At one radial surface and circumferencially arranged with respect to the throughbore, first plate 6 has an axially projecting shoulder 8 including three triangular notches 10 circumferencially arranged to receive sprocket teeth 3 to mate the first plate 6 to sprocket 2 for mutual rotation. Opposite shoulder 8 first plate 6 has a coaxially disposed cylindrical collar 12 defining a first flange 14. An annular recess 16 is fashioned at the periphery of first flange 14 for purposes which will hereinafter become evident.

Secured to first plate 6 for coaxially rotation therewith is a second plate 18. In a fashion mirroring the first plate 6, the second plate 18 includes a coaxial, axially projecting collar 20 defining a second flange 22. An annular recess 24 is fashioned at the periphery of second flange 22 to align with recess 16 on first flange 14. An axially throughbore 26 to passes crankshaft 1. To secure the first plate 6 to second plate 18, flathead screws 28 are received through aligned threaded bores 30 cooperatively located in the first and second plates 6, 18.

Accordingly, it is seen that the first and second plates 6, 18 are fixed together for mutual rotation and, furthermore, are fixed to crankshaft 1 and sprocket 2 to communicate the rotation of crankshaft 1 to sprocket 2. While first plate 6 is broached to couple the device 4 to crankshaft 1, it is to be understood that the second plate 18, in addition to or instead of the first plate 6, could have a broached throughbore to accomplish the same end.

To cooperate with the first and second plates 6, 18 to suppress piston firing torque related vibrations, device 4 includes a pair of inertial rings 32, 34. As shown in FIGS. 1 through 3, inertial rings 32, 34, are virtually mirror images of one another, including an axial hole 36 to pass crankshaft 1 and to nest the rings on collars 12, 20 respectively for coaxially rotation relative to first plate and second plate 6, 18. Specifically, hole 36 in ring 32 passes collar 12 to mount ring 32 for coaxial rotation relative to first plate 6 whereas hole 36 in ring 34 receives collar 20 to mount ring 34 for coaxial rotation relative to second plate 18.

To fix inertial rings 32, 34 for mutual rotation while at the same time permitting axial relative displacement, device 4 includes at least one and preferably a pair of axially projecting pins 38 as shown in FIGS. 2 and 3. As shown in the drawing, pins 38 may be diametrically disposed and fixed to ring 34 to be received in aligned bores 40 in ring 32. It is to be understood that pins 38 could likewise be fixed to ring 32 and project into bores 40 at ring 34.

To provide for frictional coupling between inertial rings, 32, 34 and first plate and second plate 6, 18 annular friction discs 42, 44 are provided. Discs 42, 44 may be fashioned from a suitable friction material but, graphite impregnated phenolic resin is preferred. Disc 42 is received by peripheral recess 16 of first plate 6 as shown in FIGS. 3 and 4. An annular seat 46 is fashioned in ring 32 to cooperate with recess 16 to receive and mount disc 42. In a similar fashion, disc 44 is received by recess 24 of second plate 18 and is cooperatively nested therein by annular seat 46 fashioned in ring 34.

To frictionally couple the rings 32, 34 to first and second plates 6, 18 in cooperation with discs 42, 44 means are provided for urging rings 32, 34 to press discs 42, 44 against the corresponding first and second flanges 14, 22. As shown in FIGS. 2 and 4 these urging means are embodied as coil springs 48 each received into aligned, cylindrical receptacles 50 disposed in rings 32, 34. Spacers 52 are used to adjust the spring force exerted between rings 32, 34. Urging means may be any other suitable device such as bellview springs or the like.

As can be appreciated, springs 48 urge rings 32, 34 to impose a force against discs 42, 44 and first and second flanges 14, 22 to frictionally couple rings 32, 34 to first and second plate 6, 18 for mutual rotation with shaft 1 and sprocket 2.

As can be understood, rings 32, 34, based upon their mass, possess an inertia which must be overcome to change the rate of rotation of the rings, i.e., angular velocity. The force necessary to overcome this inertia, according to the device 4 of the present invention, is transmitted from first and second plates 6, 18 through friction discs 42, 44 to rings 32, 34. When a torque from crankshaft 1 is over a pre-selected value, the frictional coupling between first and second plates 6, 18 and rings 32, 34 is not sufficient to maintain mutual rotation and first and second plates 6, 18 rotate relative to inertial rings 32, 34 resisted by friction imposed by discs 42, 44 and rings 32, 34.

With reference to the specific 90 cubic inch Evo-twin Harley-Davidson motorcycle engine referred to above, it has been found that providing inertial rings, springs and spacers which have a combined weight of 2½ pounds friction discs and urging means such that the torque necessary to enable the plates to frictionally slip relative to rings at approximately 240 inch pounds provides the aforesaid suppression of vibrations related to piston firing impulse torques.

To secure the device 4 against axial movement on crankshaft 1, a bolt 54 threads axially into shaft 1. A washer 56 is disposed between second plate 18 and bolt 56 to facilitate the fastening of device 4 on shaft 1.

As can be appreciated, device 4 according to the present invention is particularly well suited as an after market item for the engine described above. The crankshaft casing is simply removed as is the compensator. Device 4 is thereafter placed over shaft 1 and secured in place by bolt 54 in the manner described above. The casing is then replaced. Casting webs of the engine casing for the crankshaft may require a minor milling to accommodate the device 4 according to the present invention in some motorcycle models.

While we have described a device particularly adapted to the 90 cubic inch Evo-twin motorcycle engine manufactured by Harley-Davidson, it is to be understood that the device is also well adapted for prior comparable engines manufactured by Harley-Davidson or like engines which experience intermittent or inadvertent piston firing torque impulses and related vibrations.

While we have described a device according to the present invention for suppression of vibration related to firing impulse torques.

We claim:

1. A device in a vehicle drive train at the output end of an internal combustion engine crankshaft to suppress firing impulse torque related vibration, said drive train including a drive sprocket freely coaxially rotatable relative to the crankshaft said drive sprocket providing input to a transmission to drive the vehicle, said device comprising:

a first plate adapted to be coupled to the drive sprocket for coaxial rotation therewith;

a second plate attached to the first plate for coaxial rotation therewith, at least one of said first or second plates attached to the crankshaft so that said plates and sprocket coaxially rotate with and are driven by the crankshaft;

a first inertial ring;

a second inertial ring, said first and second inertial rings coupled for mutual co-axial rotation, said inertial rings coaxially disposed between said first and second plates;

friction discs disposed between the inertial rings and plates; and means for urging the inertial rings to press the discs between said rings and plates to frictionally slip couple the rings to the plates to rotate coaxially therewith below a pre-selected value of firing impulse torque, said plates frictionally slipping relative to the rings above said pre-selected value to suppress vibration related to firing impulse torques.

2. The device of claim 1 wherein one of said inertial rings includes a pair of axially projecting pins and the other of said inertial rings include a pair of bores, each adopted to receive a pin to couple said rings for mutual coaxial rotation.

3. The device of claim 1 wherein said sprocket includes axially projecting teeth, said first plate having axial disposed notches each adapted to receive a corresponding tooth to engage said first plate with said sprocket.

4. The device of claim 1 wherein said urging means are coil springs disposed between said inertial rings.

5. The device of claim 4 wherein said pre-selected firing impulse torque is 240 inch-pounds.

6. In a vehicle having an internal combustion engine with a crankshaft having an output end, a transmission and a sprocket freely rotatable about said output end, said sprocket engaging a chain which provides input to the transmission, said sprocket having axially projecting teeth, the improvement comprising:

a first plate fixed to the crankshaft output end to rotate therewith, said first plate including recesses to receive said teeth to couple the first plate to the sprocket for mutual coaxial rotation;

a second plate spaced from the first plate and attached thereto to rotate with the first plate and crankshaft;

a pair of inertial rings disposed between and coaxially rotatable relative to the first and second plates;

means for restraining said rings against mutual coaxial rotation;

a friction surface disposed between each of the first and second plates and the rings; and means for axially urging said rings to cooperate with the friction surfaces to frictionally couple said rings to said plates to coaxially rotate their width below a pre-selected firing impulse torque, said plates frictionally slipping above said pre-selected firing impulse torque to suppress vibrations related to firing impulse torque.

* * * * *